US005882179A

United States Patent [19]

Ota et al.

[11] Patent Number: 5,882,179

[45] Date of Patent: Mar. 16, 1999

[54] COMPRESSOR WITH BEARING BETWEEN THE DRIVE SHAFT AND THE SWASH-PLATE BOSS

[75] Inventors: Masaki Ota; Youichi Okadome; Masaru Hamasaki; Hisakazu Kobayashi, all of Kariya, Japan

[73] Assignee: Kabushiki Kaisha Toyoda Jidoshokki Seisakusho, Kariya, Japan

[21] Appl. No.: 747,648

[22] Filed: Nov. 13, 1996

[30] Foreign Application Priority Data

Nov. 24, 1995 [JP] Japan ..... 7-305805

[51] Int. Cl.[6] ..... F04B 1/26

[52] U.S. Cl. ..... 417/222.2; 417/222.1; 92/71

[58] Field of Search ..... 417/222.1, 222.2; 91/499; 92/71

[56] References Cited

U.S. PATENT DOCUMENTS

| | | | |
|---|---|---|---|
| 3,056,387 | 10/1962 | Budzich | 121/119 |
| 3,785,751 | 1/1974 | Nemoto et al. | 417/269 |
| 4,037,522 | 7/1977 | Inoshita et al. | 92/71 |
| 4,869,154 | 9/1989 | Takahashi et al. | 92/71 |
| 5,112,197 | 5/1992 | Swain et al. | 417/222 R |
| 5,165,321 | 11/1992 | Arimoto et al. | 91/499 |
| 5,316,446 | 5/1994 | Kimura et al. | 417/269 |
| 5,336,056 | 8/1994 | Kimura et al. | 417/222.1 |
| 5,415,077 | 5/1995 | Ono | 92/71 |

FOREIGN PATENT DOCUMENTS

| | | |
|---|---|---|
| 6-287678 | 10/1985 | Japan . |
| 62-162777 | 1/1986 | Japan . |
| 6-249143 | 2/1993 | Japan . |
| 6-307335 | 11/1994 | Japan . |

*Primary Examiner*—Charles G. Freay
*Assistant Examiner*—Ehud Gartenberg
*Attorney, Agent, or Firm*—Morgan & Finnegan, L.L.P.

[57] ABSTRACT

A variable displacement compressor used in air conditioners is provided with a tilting swash plate to vary its displacement. A drive shaft extends through a boss of the swash plate. A hole is defined in the boss by a pair of intersecting conical walls. The position of the swash plate is restricted by the contact between the walls of the hole and the drive shaft. The walls of the hole also allow the swash plate to incline without interference. A bearing element is arranged at a central angled section defined in the walls of the hole. The bearing element is located at a position that is opposite from a hinge mechanism with respect to the drive shaft. A concave seat is provided in the boss at this position to receive the bearing element. The bearing element includes a cylindrical surface engaging the outer surface of the drive shaft.

20 Claims, 5 Drawing Sheets

COMPRESSOR WITH BEARING BETWEEN THE DRIVE SHAFT AND THE SWASH-PLATE BOSS

BACKGROUND OF THE INVENTION

1. Field of the Invention

The present invention relates to compressors used in air-conditioners, and more particularly, to variable displacement compressors that employ swash plates to vary their displacement.

2. Description of the Related Art

A variable displacement compressor is a compressor provided with a structure that enables its displacement to be varied. A swash plate compressor is one type of variable displacement compressor. A typical swash plate compressor includes a drive shaft, a swash plate, and pistons. The swash plate (including a structure that couples the swash plate to a lug plate) is mounted on the drive shaft and supported so as to rotate integrally with the shaft. The pistons are accommodated in cylinder bores and coupled to the swash plate. The rotation of the swash plate is converted to linear reciprocation of the pistons. The reciprocation of the pistons compresses fluid that is drawn into the cylinder bores. The inclination of the swash plate with respect to the drive shaft changes the reciprocating stroke of the pistons and thus varies the compressor displacement.

Japanese Unexamined Patent Publication 62-87678 describes one type of swash plate compressor. In this compressor, the structure connecting the swash plate to the drive shaft is simplified. As shown in FIG. 8, a swash plate 60 has a boss 60*a*. The wall of a hole 62 extending through the boss 60*a* includes a rounded surface 62*a*. The swash plate 60 is installed on the drive shaft 61 by inserting the shaft 61 through the hole 62. The radial position of the swash plate 60 is restricted by the sectional contact between the wall of the hole 62 and the drive shaft 61. The rounded surface 62*a* in the wall of the hole 62 allows the swash plate 60 to incline. This compressor is characterized by the hole 62, which substitutes for sliders and pins that were used in the prior art to incline the swash plate 60 within a predetermined range. The contact between the rounded surface 62*a* of the hole 62 and the drive shaft 61 guides the inclining of the swash plate 60 and restricts the inclination within the predetermined range. Pistons 63 are coupled to the swash plate 60 and are reciprocated in associated cylinder bores 64. The reciprocation of each piston 63 compresses fluid that is drawn into each associated bore 64.

In the compressor described in the above publication, the compression reaction of the pistons produces a moment that acts on the swash plate 60. A hinge mechanism 67 constituted by an elongated hole 65 and a pin 66 is provided to carry the moment together with the rounded surface 62*a*, which contacts the drive shaft 61. However, as the inclination of the swash plate 60 is altered, the contact point between the rounded surface 62*a* and the drive shaft 61 is axially displaced within a predetermined range. The displacement defines a line of contact between the rounded surface 62*a* and the drive shaft 61. The stress applied between the rounded surface 62*a* and the drive shaft 61 along the line of contact is relatively great. In addition, the range of the line of contact is relatively long and the contact at each point is repeated limitlessly. This causes wear between the rounded surface 62*a* and the drive shaft 61. The wear may hinder the precise and smooth inclining of the swash plate 60.

SUMMARY OF THE INVENTION

Accordingly, it is a primary objective of the present invention to provide a swash plate type variable displacement compressor that enables smooth inclination of the swash plate with a simple structure.

To achieve the foregoing and other objects and in accordance with the purpose of the present invention, a variable displacement compressor is provided. The compressor has a swash plate supported on a drive shaft, wherein the swash plate includes a boss. The compressor comprises a rotor secured to the drive shaft, a hinge mechanism for connecting the swash plate with the rotor, at least one cylinder bore arranged about the drive shaft, one piston accommodated for reciprocation in each cylinder bore, wherein the swash plate is coupled to and reciprocates each piston in accordance with the undulating rotation of the swash plate. The compressor comprises a suction chamber for supplying gas to the cylinder bore, a discharge chamber for receiving gas from the cylinder bore, wherein the gas supplied to the cylinder bore from the suction chamber is compressed by each piston and is discharged to the discharge chamber from the cylinder bore in accordance with the reciprocation of each piston, a hole formed centrally in the boss, wherein the hole has a pair of intersecting conical walls extending through the boss and an angled section located between the conical walls, and wherein the swash plate is installed on the drive shaft by inserting the drive shaft through the hole, and wherein the swash plate is tiltable with respect to the axis of the drive shaft by way of the hole and wherein the swash plate rotates and undulates with the rotation of the drive shaft by way of the hinge mechanism, wherein the swash plate is arranged to move along an axial direction of the drive shaft and to incline within a predetermined range with respect to the axis of the drive shaft so as to vary the volume of discharged gas from the cylinder bore, and a bearing means for reducing stress produced between the angled section of the hole and the drive shaft, wherein said bearing means is located between the angled section and the drive shaft.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of a swash plate type variable displacement compressor according to the present invention will hereafter be described with reference to FIGS. 1–3.

Figure 1:
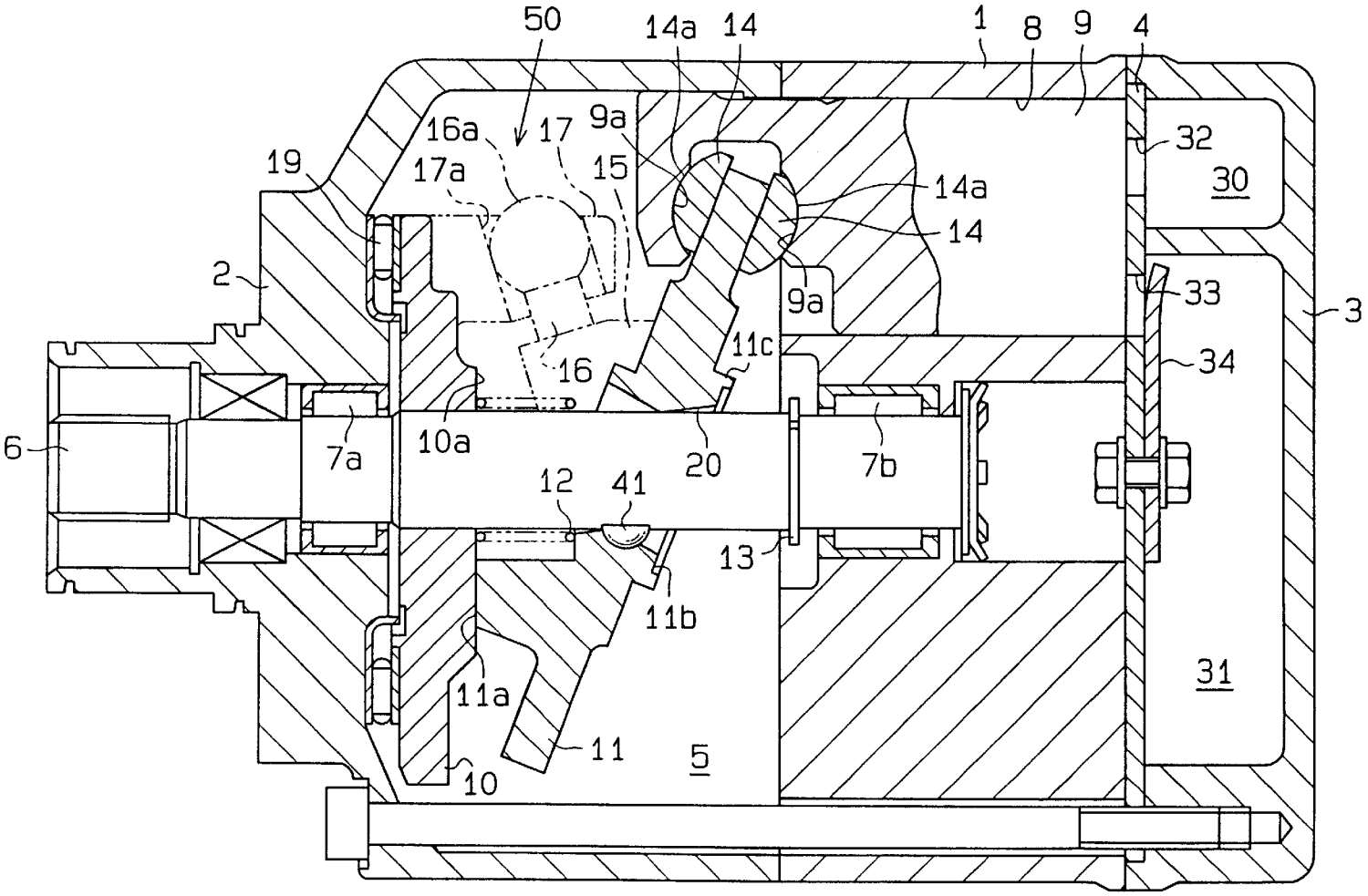
FIG. 1 is a cross-sectional view of a compressor according to a first embodiment of the present invention.

As shown in FIG. 1, the compressor has a cylinder block 1, a front housing 2, and a rear housing 3. The front housing 2 is secured to the front end of the block 1. The rear housing 3 is secured to the rear end of the block 1 with a valve plate 4 provided therebetween. A drive shaft 6 extends through the center of the block 1 and the front housing 2. Bearings 7*a*, 7*b* are arranged in the block 1 and the front housing 2, respectively, to rotatably support the drive shaft 6. A crank chamber 5, through which the drive shaft 6 extends, is defined in the block 1 and the front housing 2. A plurality of cylinder bores 8 extend through the block 1 about the drive shaft 6. A piston 9 is accommodated for reciprocation in each bore 8.

A rotor 10 is fixed to the drive shaft 6 in the crank chamber 5. A bearing 19 enables the rotor 10 to rotate with respect to the front housing 2. A swash plate 11 is mounted on a drive shaft 6. The swash plate 11 is supported in a manner such that it may be inclined with respect to the axis of the shaft 6. A boss 11c is provided at the center of the swash plate 11. A hole 20 having a pair of conical walls extends through the boss 11c. The swash plate 11 is installed on the shaft 6 by inserting the shaft 6 through the hole 20.

A coil spring 12 is provided between the rotor 10 and the swash plate 11 to urge the swash plate 11 toward the cylinder block 1. Each piston 9 is coupled to the peripheral section of the swash plate 11 by a pair of shoes 14. Each shoe 14 has a hemispheric surface 14*a*. Concave surfaces 9*a* are defined in each piston 9 to receive the spheric surface 14*a* of each shoe 14.

The swash plate 11 is coupled to the rotor 10 by a hinge mechanism 50. The hinge mechanism 50 includes a bracket 15, a guide pin 16, and an arm 17. The bracket 15 projects from the front side of the swash plate 11. The guide pin 16 is fixed to the bracket 15. The arm 17 projects from the rear side of the rotor 10 and is parallel to the drive shaft 6. A spherical body 16*a* is provided at the distal end of the guide pin 16. A guide hole 17*a* is defined in the arm 17. The axis of the guide hole 17*a* is inclined with respect to the axis of the drive shaft 6 as seen in FIG. 1. The spherical body 16*a* is slidably received in the guide hole 17*a*. The inclined axis of the guide hole 17*a* substantially restricts the top dead center of each piston 9 from being displaced when the swash plate 11 is tilted.

A restriction ring 13 is fastened to the drive shaft 6 near the bearing 7*b*. A counterbore surface 11*b* is defined at the rear end of the boss 11*c*. Abutment between the counterbore surface 11*b* and the restriction ring 13 restricts the rearward movement of the swash plate 11. A projection 11*a* projects from the front side of the swash plate 11. Abutment between the projection 11*a* and the rear surface 10*a* of the rotor 10 restricts the inclination of the swash plate 11 toward the front of the compressor.

A suction chamber 30 and a discharge chamber 31 are defined in the rear housing 3. The valve plate 4 is provided with a suction port 32 and a discharge port 33 for each cylinder bore 8. A compression chamber is defined in each cylinder bore 8 between the valve plate 4 and the piston 9. The compression chamber is connected to the suction chamber 30 and the discharge chamber 31 through the suction port 32 and the discharge port 33, respectively. Refrigerant gas is drawn into the suction chamber 30, the discharge chamber 31, and the compression chamber. A suction valve (not shown) is provided in each suction port 32 to selectively open and close the port 32 in correspondence with the reciprocation of the associated piston 9. A discharge valve (not shown) is provided in each discharge port 33 to selectively open and close each port 32 in correspondence with the reciprocation of the associated piston 9. A retainer 34 is provided for each discharge port 33 to restrict the movement of the associated discharge valve. A control valve (not shown) is provided in the rear housing 3 to adjust the pressure in the crank chamber 5.

Figure 2:
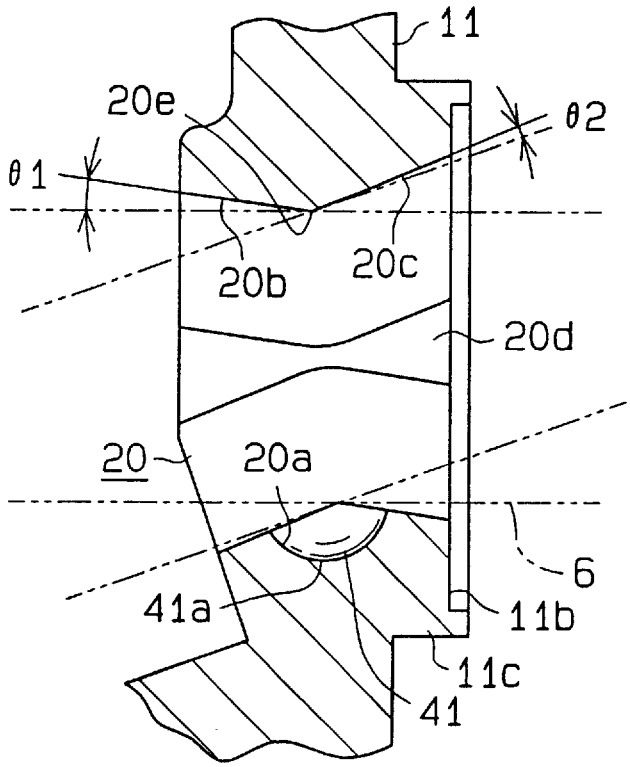
FIG. 2 is an enlarged partial cross-sectional view showing the engagement between a bearing element and a drive shaft.
Figure 3:
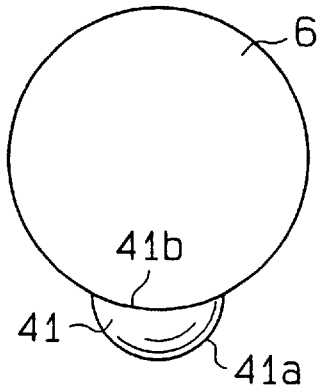
FIG. 3 is an explanatory drawing illustrating the engagement of the bearing element and the drive shaft shown in FIG. 2.

As shown in FIG. 2, the hole 20 has an angled center section, which includes an intersection point 20*e*, at which the diameter of the hole 20 is smallest. A tapered first surface 20*b* extends toward the front end of the hole 20 from the intersection point 20*e* while a second surface 20*c* extends toward the rear end of the hole 20 from the intersection point 20*e*. The angle between the first surface 20*b* and the axis of the boss 11*c* is less than the angle between the second surface 20*c* and the same axis. The inclination of each surface 20*b*, 20*c* allows the tilting of the swash plate 11. The first surface 20*b* is tapered to obtain play angle θ1 within a range of 10 to 15 degrees between the surface 20*b* and the drive shaft 6. The second surface 20*c* is tapered to create play angle θ2 within a range of 1 to 2 degrees between the surface 20*c* and the drive shaft 6. A pair of opposed restriction surfaces 20*d* is provided in the walls of the hole 20.

As shown in FIG. 1, a bearing element 41 is arranged at the angled center section of the hole 20 between the wall of the hole 20 and the drive shaft 6. The bearing element 41 is located at a position diametrically opposite to the hinge mechanism 50 with respect to the shaft 6. As shown in FIG. 2, a spherical concave seat 20*a* is provided in the wall of the hole 20 to receive the bearing element 41. The bearing element 41 is hemispheric and has a spherical surface 41*a* and an cylindrical surface 41*b*. The spherical surface 41*a* is received in the concave seat 20*a*. The shape of the cylindrical surface 41*b* corresponds to the outer surface of the drive shaft 6 and enables the surface 41*b* to engage the shaft 6.

When the compressor is operated, the drive shaft 6 rotates together with the swash plate 11. The undulating rotation of the swash plate 11 is converted to linear reciprocation of each piston 9 in the associated cylinder bore 8 by way of the corresponding pair of shoes 14. Refrigerant gas is drawn into the compression chamber defined in each cylinder bore 8 from the suction chamber 30 by the reciprocation of the associated piston 9. The refrigerant gas is compressed in the compression chamber and then discharged into the discharge chamber 31. The volume of the refrigerant gas discharged into the discharge chamber 31 is adjusted in accordance with the pressure in the crank chamber 5, which is controlled by the control valve (not shown).

When the pressure in the crank chamber 5 is raised by the control valve from the state shown in FIG. 1, the pressure acting on the rear side of each piston 9 increases. This lessens the inclination of the swash plate 11 with respect to the axis of the drive shaft 6. In other words, the spherical body 16*a* of the hinge mechanism 50 slides toward the axis of the drive shaft 6 in a counterclockwise direction, as viewed in FIG. 1, along the walls of the guide hole 17*a*. Simultaneously, the swash plate 11, which is supported by the bearing element 41, is moved along the shaft 6 by the coil spring 12. Contact between the cylindrical surface 41*b* of the bearing element 41 and the drive shaft 6 is maintained during the movement of the swash plate 11. This action causes the plane of the swash plate 11 to approach a perpendicular relationship with the axis of the shaft 6. The altered inclination of the swash plate 11 shortens the reciprocation stroke of each piston 9 and reduces the compressor displacement. The compressor displacement becomes minimum when the counterbore surface 11*b* of the swash plate 11 abuts against the restriction ring 13.

When the compressor displacement is small, the pressure acting on the rear side of each piston 9 decreases if the control valve lowers the pressure in the crank chamber 5. This increases the inclination of the swash plate 11 with respect to the axis of the drive shaft 6. In other words, the spherical body 16*a* of the hinge mechanism 50 slides away from the axis of the drive shaft 6 in a clockwise direction, as viewed in FIG. 1, along the walls of the guide hole 17*a*. Simultaneously, the swash plate 11, which is supported by the bearing element 41, is tilted and moved along the shaft 6 against the force of the coil spring 12. Contact between the cylindrical surface 41*b* of the bearing element 41 and the drive shaft 6 is maintained during the tilting of the swash plate 11. This action increases the inclination of the swash plate 11 with respect to the axis of the shaft 6. The altered inclination of the swash plate 11 lengthens the reciprocation stroke of each piston 9 and increases the compressor displacement. The compressor displacement becomes maximum when the projection 11*a* of the swash plate 11 abuts against the rear surface 10*a* of the rotor 10.

As the inclination of the swash plate 11 is altered, the cylindrical surface 41*b* of the bearing element 41 arranged in the hole 20 slides along the outer surface of the drive shaft 6. This prevents direct contact between the conical walls of the hole 20 and the drive shaft 6. Thus, no line of contact, along which stress is applied, is produced in this structure. Spherical area contact takes place between the swash plate 11 and the bearing element 41 and cylindrical area contact takes place between the bearing element 41 and the drive shaft 6. Accordingly, wear, which takes place on both the wall of the hole 20 and the drive shaft 6, is suppressed by the simple structure described above.

In this embodiment, the concave seat 20*a*, which receives the bearing element 41, may be simply provided regardless of the type of the hinge mechanism 50. That is, a step of machining a single location in the angled center section of the wall of the hole 20 is added to the machining process to acquire the advantageous effects of the present invention. This minimizes the total number of steps required to manufacture the compressor.

A second embodiment of a swash plate type variable displacement compressor according to the present invention will hereafter be described with reference to FIGS. 4 and 5. In the following embodiments including this embodiment, parts that are identical to those employed in the first embodiment are denoted with the same numeral. Parts differing from the first embodiment will be described below.

Figure 4:
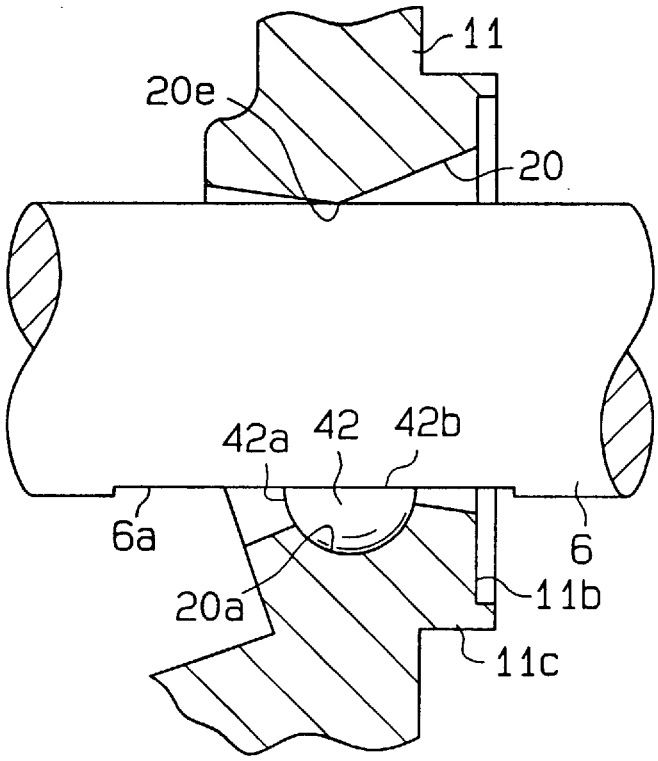
FIG. 4 is an enlarged partial cross-sectional view showing the engagement of a bearing element and a drive shaft employed in a compressor according to a second embodiment of the present invention.
Figure 5:
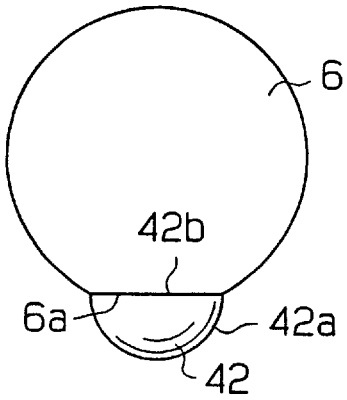
FIG. 5 is an explanatory drawing illustrating the engagement of the bearing element and the drive shaft shown in FIG. 4.

As shown in FIGS. 4 and 5, the drive shaft 6 is machined to define a plane surface 6*a*. The flat surface 6*a* is provided at a position near where the axis of hole 17*a* intersects the axis of the shaft 6. In this embodiment, a bearing element 42 includes a spherical surface 42*a* and a flat surface 42*b*. The spherical surface 42*a* is received in the concave seat 20*a* while the flat surface 42*b* is engaged with the planar surface 6*a*. The advantageous effects obtained in the first embodiment are also obtained in this embodiment.

The outer surface of the drive shaft 6 requires machining in this embodiment. However, in this embodiment, torque is not exclusively transmitted between the hinge mechanism 50 and the swash plate 11 but is also transmitted between the drive shaft 6 and the swash plate 11. This structure thus allows a decrease in the strength of the hinge mechanism 50 that is required for the transmission of torque.

A third embodiment of a swash plate type variable displacement compressor according to the present invention will hereafter be described with reference to FIGS. 6 and 7.

Figure 6:
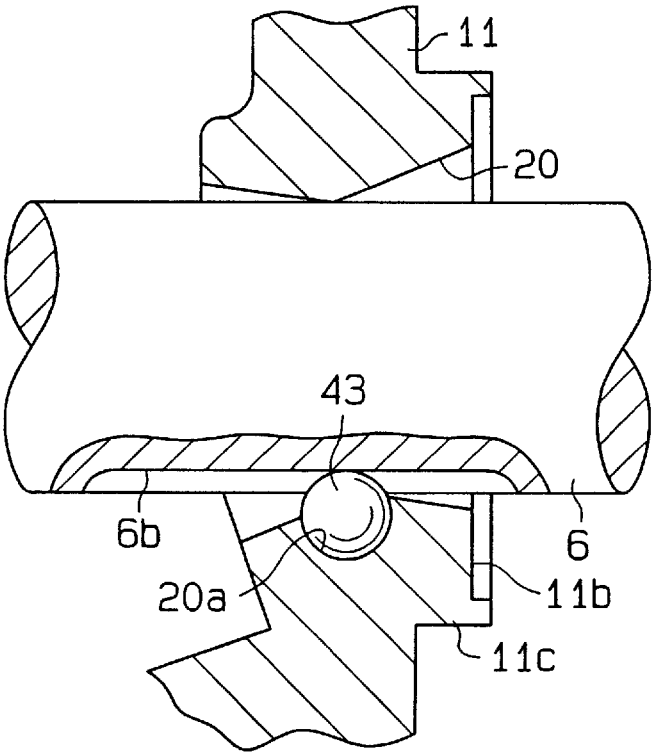
FIG. 6 is an enlarged partial cross-sectional view showing the engagement of a bearing element and a drive shaft employed in a compressor according to a third embodiment of the present invention.
Figure 7:
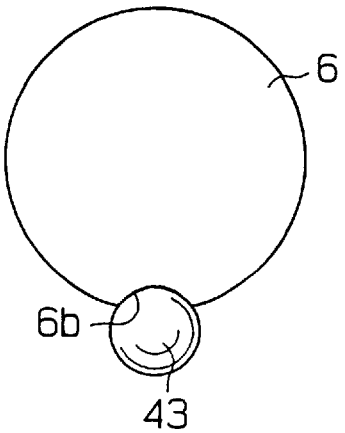
FIG. 7 is an explanatory drawing illustrating the engagement of the bearing element and the drive shaft shown in FIG. 6.
Figure 8:
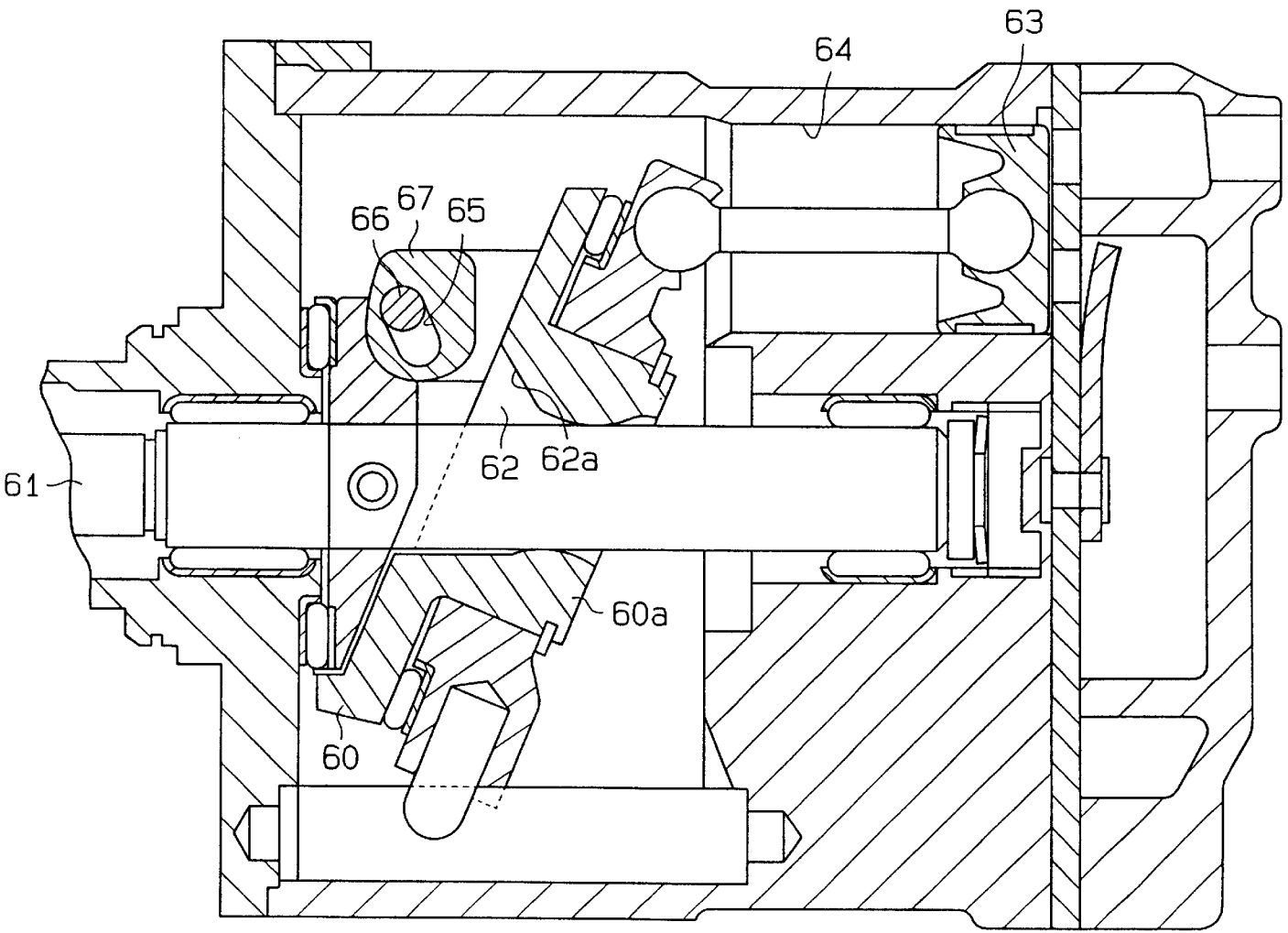
Fig. 8 (Prior Art)
FIG. 8 is a cross-sectional view showing a prior art compressor.

As shown in FIGS. 6 and 7, a spherical bearing element 43 is employed in this embodiment. An elongated groove 6*b* is defined in the drive shaft 6. The groove 6*b* has a cross-section that corresponds to the spherical surface of the bearing element 43. A portion of the bearing element 43 is received in the concave seat 20*a* while another portion of the element 43 is received in the groove 6*b*. The advantageous effects obtained in the first and second embodiments are also obtained in this embodiment.

A line of contact, along which stress is applied, is defined between the bearing element 43 and the elongated groove 6*b* in this embodiment. However, the bearing element 43 rolls freely in the elongated groove 6*b*. This dramatically suppresses wear that takes place along the section where the bearing element 43 and the groove 6*b* contact each other.

Although only three embodiments of the present invention have been described herein, it should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope of the appended claims.

What is claimed is:

1. A variable displacement compressor having a swash plate supported on a drive shaft, wherein the swash plate includes a boss, said compressor comprising:

a rotor secured to the drive shaft;

a hinge mechanism for connecting the swash plate with the rotor;

at least one cylinder bore arranged about the drive shaft;

one piston accommodated for reciprocation in each cylinder bore, wherein the swash plate is coupled to and reciprocates each piston in accordance with the undulating rotation of the swash plate;

a suction chamber for supplying gas to the cylinder bore;

a discharge chamber for receiving gas from the cylinder bore, wherein the gas supplied to the cylinder bore from the suction chamber is compressed by each piston and is discharged to the discharge chamber from the cylinder bore in accordance with the reciprocation of each piston;

a hole formed centrally in the boss, wherein the hole has a pair of intersecting conical walls extending through the boss and an angled section located between the conical walls, and wherein the swash plate is supported on the drive shaft by the drive shaft passing through the hole, and wherein the swash plate is tiltable with respect to the axis of the drive shaft by way of the hole and wherein the swash plate rotates and undulates with the rotation of the drive shaft by way of the hinge mechanism;

wherein the swash plate is arranged to move along an axial direction of the drive shaft and to incline within a predetermined range with respect to the axis of the drive shaft so as to vary the volume of discharged gas from each cylinder bore; and bearing means for reducing stress produced between the angled section of the hole and the drive shaft, wherein said bearing means is located between the angled section and the drive shaft.

2. The compressor as set forth in claim 1, wherein said bearing means includes:

a bearing element arranged between the angled section of the hole and the drive shaft, wherein the bearing element includes a spherical surface and another surface opposite to the spherical surface;

a spherical concave seat for receiving the spherical surface of the bearing element, wherein the seat is formed in the angled section; and wherein the other surface has a shape corresponding to the outer surface of the drive shaft and wherein the shape enables the other surface to engage the drive shaft.

3. The compressor as set forth in claim 1 further comprising a pair of shoes for connecting each piston with the swash plate.

4. The compressor as set forth in claim 1, wherein said hinge mechanism includes a bracket, a guide pin and an arm, and wherein the bracket projects from a side of the swash plate, and wherein the guide pin is fixed to the bracket and has a spherical body at a distal end thereof, and wherein the arm projects from a side of the rotor and includes a guide hole and wherein said spherical body is slidably received in the guide hole.

5. The compressor as set forth in claim 1, wherein said hole includes a first end and a second end opposite to the first end, and wherein said angled section of the hole includes an intersection point and wherein said conical walls include a tapered first surface extending toward the first end from the intersection point and a tapered second surface extending toward the first end from the intersection point.

6. The compressor as set forth in claim 5, wherein said first surface and the axis of the boss form a first angle with each other, wherein said second surface and the axis form a second angle with each other, and wherein the first angle is less than the second angle and wherein the first angle and the second angle allow the swash plate to incline without interference with the shaft.

7. The compressor as set forth in claim 6, wherein said first angle is a play angle within a range of ten to fifty degrees and wherein said second angle is a play angle within a range of one to two degrees.

8. The compressor as set forth in claim 2, wherein said other surface of the bearing element includes a cylindrical surface corresponding to a cylindrical outer surface of the drive shaft.

9. The compressor as set forth in claim 8 further comprising a pair of shoes for connecting each piston with the swash plate.

10. The compressor as set forth in claim 2, wherein said hinge mechanism includes a bracket, a guide pin and an arm, and wherein the bracket projects from a side of the swash plate, and wherein the guide pin is fixed on the bracket and has a spherical body at a distal end thereof, and wherein the arm projects from a side of the rotor and includes a guide hole and wherein the spherical body is slidably received in the guide hole.

11. The compressor as set forth in claim 8, wherein said hole includes a first end and a second end opposite to the first end, and wherein said angled section of the hole includes an intersection point and wherein said conical walls include a tapered first surface extending toward the first end from the intersection point and a tapered second surface extending toward the first end from the intersection point.

12. The compressor as set forth in claim 11, wherein said first surface and the axis of the boss form a first angle with each other, wherein said second surface and the axis form a second angle with each other, and wherein the first angle is less than the second angle and wherein the first angle and the second angle allow the swash plate to incline without interference with the shaft.

13. The compressor as set forth in claim 12, wherein said first angle is a play angle within a range of ten to fifty degrees and wherein said second angle is a play angle within a range of one to two degrees.

14. The compressor as set forth in claim 2, wherein said drive shaft has a planar surface on the outer surface thereof extending along the axis of the drive shaft, wherein said other surface of the bearing element includes a flat surface and wherein the planar surface engages the flat surface.

15. The compressor as set forth in claim 1, wherein said bearing means includes:

a bearing element arranged between the angled section of the hold and the drive shaft, wherein the bearing element is a spherical bearing;

a spherical concave seat for receiving a portion of the spherical bearing, wherein the seat is formed in the angled section; and wherein the drive shaft has an elongated groove formed on its outer surface extending axially along the drive shaft, and wherein said elongated groove has a cross-section corresponding to an engaging portion of the spherical bearing.

16. A variable displacement compressor comprising:

a drive shaft;

a rotor secured to the drive shaft;

a generally planar swash plate mounted on and surrounding the drive shaft, wherein the swash plate includes a central boss having a hole formed therein, which is occupied by the drive shaft;

a hinge mechanism on said rotor at one position with respect to the drive shaft for pivotally connecting the swash plate with the rotor and for driving the swash plate to rotate with the rotor and the drive shaft;

at least one cylinder bore arranged about the drive shaft;

one piston accommodated for reciprocal movement within each bore, wherein each piston is connected to and is variably reciprocated by the swash plate;

a bearing located between the boss and the drive shaft at a position that is opposite to the hinge mechanism with respect to the drive shaft, wherein the bearing engages the boss and engages the outer surface of the drive shaft and slides axially with respect to the drive shaft and permits the plane of the swash plate to tilt with respect to the axis of the drive shaft.

17. The compressor as set forth in claim 16, wherein the bearing is a hemispherical element having a cylindrical surface engaging the outer surface of the drive shaft and a spherical surface engaging the boss.

18. The compressor as set forth in claim 16, wherein the hole is defined by a pair of opposed conical intersecting surfaces such that the swash plate may tilt with respect to the drive shaft without interference between the shaft and the boss.

19. The compressor as set forth in claim 16, wherein an axial groove is formed in the surface of the drive shaft and a concave socket is formed in the boss, and wherein the bearing is a spherical element, a portion of which engages the groove and a portion of which engages the socket.

20. The compressor as set forth in claim 16, wherein a planar surface is formed on the outer surface of the drive shaft and a concave socket is formed in the boss, and wherein the bearing is a hemispheric element having a planar portion and a spherical portion such that the planar portion of the bearing engages the planar surface of the shaft and the spherical portion engages the socket.

* * * * *

UNITED STATES PATENT AND TRADEMARK OFFICE

CERTIFICATE OF CORRECTION

PATENT NO. : 5,882,179

DATED : March 16, 1999

INVENTOR(S) : Masaki Ota, et. al.

It is certified that error appears in the above-identified patent and that said Letters Patent is hereby corrected as shown below:

Column 2, line 29, change "an" to --the--.

Column 10, line 2, change "hemispheric" to --hemispherical--.

Signed and Sealed this

Seventh Day of March, 2000

*Attest:*

*Attesting Officer*

Q. TODD DICKINSON

*Commissioner of Patents and Trademarks*